US006519881B1

(12) United States Patent
Chase

(10) Patent No.: US 6,519,881 B1
(45) Date of Patent: Feb. 18, 2003

(54) STRETCHER FRAME ASSEMBLY

(76) Inventor: R. Kingsbury Chase, 39 Woodhaven Dr., Simsbury, CT (US) 06020

( * ) Notice: Subject to any disclaimer, the term of this patent is extended or adjusted under 35 U.S.C. 154(b) by 0 days.

(21) Appl. No.: 10/001,326

(22) Filed: Oct. 25, 2001

(51) Int. Cl.[7] ..... D06C 3/08
(52) U.S. Cl. ..... 38/102.1
(58) Field of Search ..... 38/102.7, 102.91, 38/102.3, 102.1; 160/371, 374.1, 375, 377, 378, 379, 381; 101/127.1; 40/700, 734, 732

(56) References Cited

U.S. PATENT DOCUMENTS 1,870,492 A 8/1932 Clark
3,886,990 A * 6/1975 Campione ..... 160/374.1
4,030,220 A * 6/1977 Kotchen ..... 40/700
5,852,974 A * 12/1998 Egan et al. ..... 101/127.1
6,253,471 B1 * 7/2001 Strauh ..... 38/102.1
6,269,562 B1 * 8/2001 Jacob ..... 38/102.91

* cited by examiner

*Primary Examiner*—Ismael Izaguirre
(74) *Attorney, Agent, or Firm*—Pandiscio & Pandiscio; Scott R. Foster

(57) ABSTRACT

A stretcher frame assembly for supporting a painting canvas includes a frame having side members fixed to each other at ends thereof, a front face defined by the frame side members declining inwardly from a peripheral surface thereof, and inwardly-extending portions of the frame side members defining inwardly extending flanges having front and rear planar surfaces. A stiff front panel is fixed to the frame with outer peripheral portions of the front panel disposed on and connected to the flange front surfaces. A stiff back panel is fixed to the frame with outer peripheral portions of the back panel disposed on and connected to the flange rear surfaces.

21 Claims, 5 Drawing Sheets

STRETCHER FRAME ASSEMBLY

BACKGROUND OF THE INVENTION

1. Field of the Invention

The invention relates to frame assemblies and is directed more particularly to a frame assembly for supporting a sheet of canvas, or the like, stretched thereover and attached thereto. The canvas typically serves as a substrate for oil painting.

2. Description of the Prior Art

It is customary to stretch a sheet of canvas over a generally rigid frame in preparation for painting on the canvas. The term "stretcher frame" is applied to such frames. Standard stretcher frames often rack out of "square" and/or warp out of plane when the canvas is tightly stretched thereon. After mounting of the canvas on the frame, the frame often warps, and the tighter the canvas is stretched, the more likely it is that the frame will warp. On occasion, wood frames warp in storage, even before use. Worse yet, on occasion wooden frames break under the tension of the stretched canvas.

In an effort to overcome such problems, frame members have been made of stronger and/or larger wooden members, or of composite materials providing greater strength and rigidity than wood. In larger frame assemblies, cross bracing is used to strengthen the frame. Unfortunately, such measures have increased costs three to four fold.

Accordingly, there is a need for a stretcher frame of light weight, low cost, and capable of remaining a square and in plane in storage prior to use, during stretching of a canvas thereon, and during any subsequent additional tensioning of the canvas. It is further desirable that the stretcher frame structure be appropriate in virtually any size.

SUMMARY OF THE INVENTION

An object of the invention is, therefore, to provide a stretcher frame assembly having sufficient strength and rigidity to remain "square" and in plane under all normal conditions of use, but of light weight and low cost.

With the above and other objects in view, a feature of the invention is the provision of a stretcher frame assembly comprising a frame having side members fixed to each other at ends thereof, a front face defined by the frame side members declining inwardly from a peripheral rounded edge thereof, and inwardly-extending portions of the frame side members defining inwardly extending flanges having front and rear planar surfaces. A stiff front panel is fixed to the frame with outer peripheral portions of the front panel disposed on and connected to the flange front surface, and a stiff back panel is fixed to the frame with outer peripheral portions of the back panel disposed on and connected to the flange rear surface.

In accordance with a further feature of the invention, there is provided a stretcher frame assembly including a frame having side members fixed to each other at ends thereof, a front face defined by the frame side members declining inwardly from a peripheral rounded edge thereof, and a groove in an inwardly-facing surface of each of the side members extending from end to end thereof. The assembly further includes a planar core member, a front panel fixed to the core member on a first side thereof, and a back panel fixed to the core member on a second side thereof. Edges of the core member and the panels are disposed in the grooves of the side members.

In accordance with a further feature of the invention, there is provided a stretcher frame assembly including a frame having side members fixed to each other at ends thereof, a front face defined by the frame side members declining inwardly from a peripheral rounded edge thereof, and first and second grooves in an inwardly-facing surface of each of the side members extending from end to end thereof. The assembly further includes a planar core member, a stiff front panel fixed to the core member on a first side thereof and having peripheral portions extending outwardly from peripheral portions of the core member, a stiff back panel fixed to the core member on a second side thereof, and having peripheral portions extending outwardly from peripheral portions of the core member, the peripheral portions of the front and back panels being disposed in the first and second grooves, respectively, of the side members.

In accordance with a still further feature of the invention, there is provided a stretcher frame assembly including a frame having side members fixed to each other at ends thereof, a front face defined by the frame side members declining inwardly from a peripheral rounded edge thereof, and a groove in an inwardly-facing surface of each of the side members extending from end to end thereof. The assembly further includes a planar core member, a front panel fixed to the core member on a first side thereof, and a back panel fixed to the core member on a second side thereof. Peripheral edges of the panels extend beyond peripheral edges of the core member to define a peripheral groove, and a perimeter strip is fixed to the core member in the peripheral groove, the perimeter strip and the peripheral edges of the panels being fixed in the frame side member grooves.

In accordance with a still further feature of the invention, there is provided a stretcher frame assembly including a frame having side members fixed to each other at ends thereof, a front face defined by the frame side members declining inwardly from a peripheral rounded edge thereof, a stiff front panel having outer peripheral portions thereof fixed to the frame, and a stiff back panel having outer peripheral portions thereof fixed to the frame. The panels are provided with tabs bendable toward each other with slots engaged by the tabs to form spacer struts between the panels.

In accordance with still another feature of the invention, there is provided a stretcher frame assembly including a frame having side members fixed to each other at ends thereof, a front face defined by the frame side members declining inwardly from a peripheral rounded edge thereof, and a groove in an inwardly-facing surface of each of the side members extending from end to end thereof. The assembly further includes a planar core member comprising spaced rigid side walls and a peripheral wall interconnecting the side walls, the core member walls defining a chamber, and a filler disposed in the chamber. A front panel is fixed to the core member on a first of the side walls of the core member, and a back panel is fixed to the core member on a second of the side walls of the core member. Edges of the core member are disposed in the grooves of the side members.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
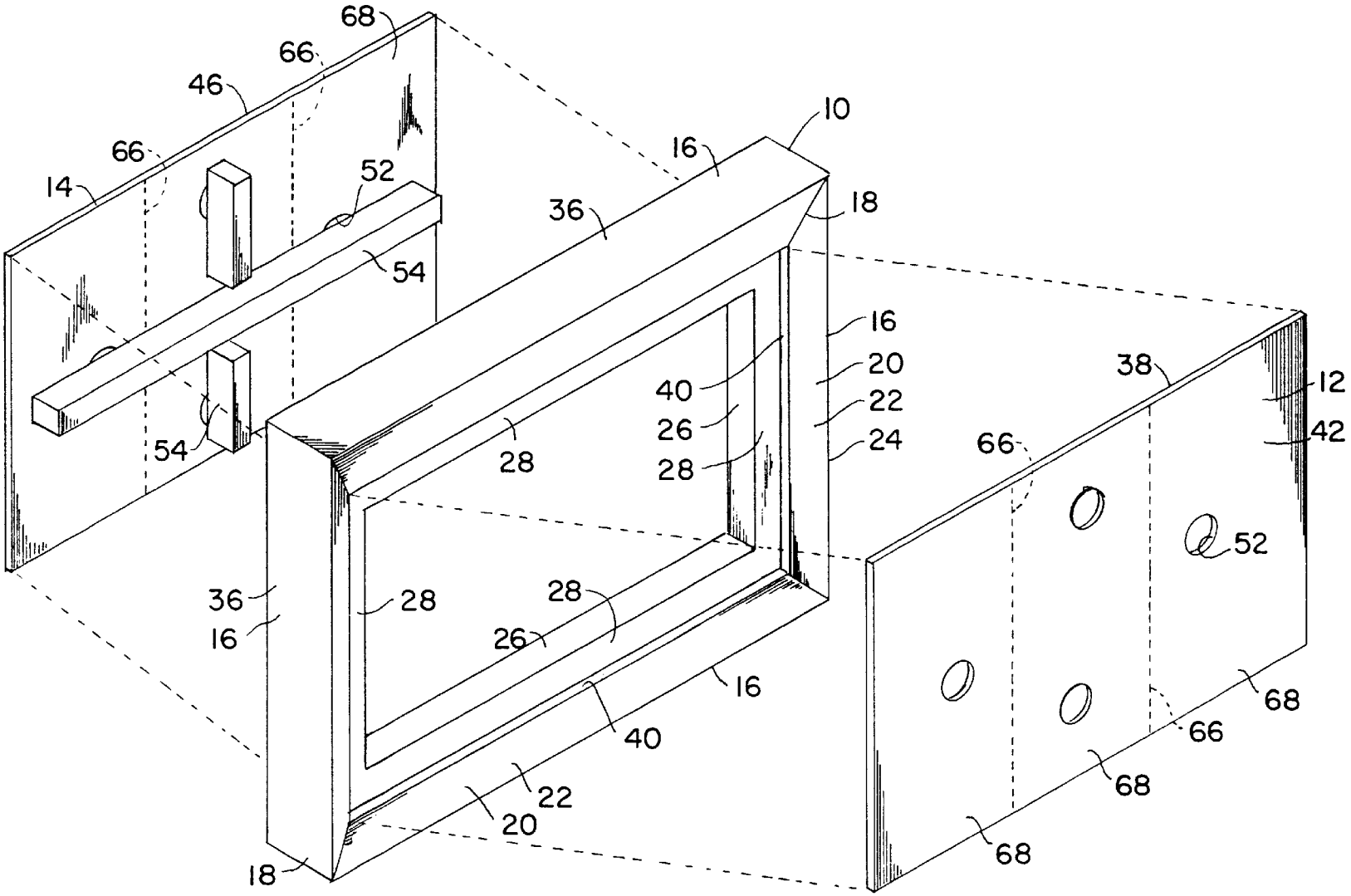
FIG. 1 is an exploded perspective view of one form of stretcher frame assembly illustrative of an embodiment of the invention.
Figure 2:
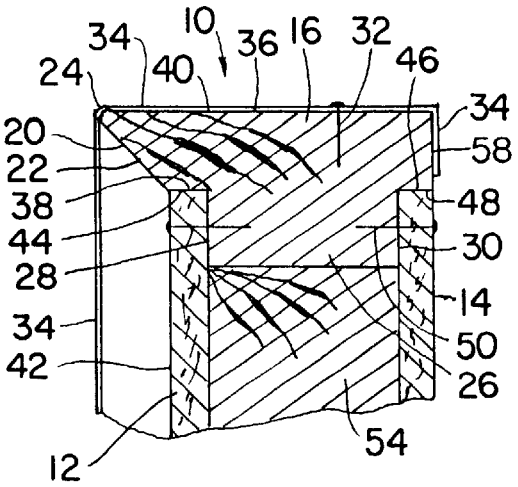
FIG. 2 is a sectional view of a portion of the assembly of FIG. 1.
Figure 3:
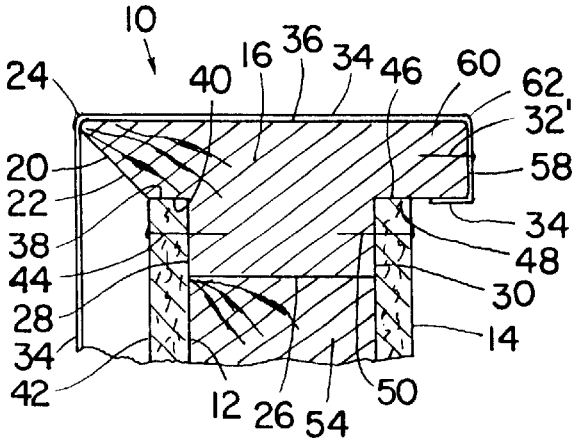
FIGS. 3–6 are sectional views, similar to FIG. 2, but illustrative of alternative embodiments.

Referring to FIGS. 1–3, it will be seen that an illustrative assembly includes a frame 10, a stiff front panel 12, and a stiff back panel 14.

The frame 10 includes rigid side members 16 fixed to each other at ends 18 thereof. The side members 16 define a front face 20 which constitutes a declining surface 22 (FIG. 2), declining inwardly from a peripheral rounded edge 24 thereof. Inwardly-extending flanges 26 of the side members 16 define inwardly-extending front and rear planar surfaces 28, 30.

Figure 4:
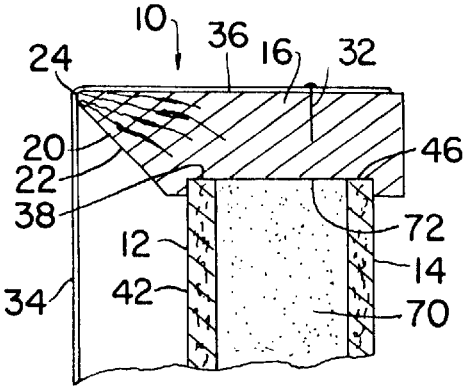

The frame side members 16 are of wood or a composite which readily accepts tacks or staples 32, as shown in FIGS. 2–4, such that a sheet of canvas 34 may be fastened to outer flat surfaces 36 of the side members 16, as will be further described hereinbelow.

The stiff front panel 12 is disposed on the front planar surfaces 28 of the flanges 26, with outer edges 38 of the front panel 12 abutting inwardly facing edges 40 of the side members 16. If the panels 12, 14 contain any wood fiber, the front panel 12 preferably is coated with a sealant material on the side 42 facing the canvas 34, to prevent expansion from water vapor emitted by damp gesso and/or acrylic paint. The front panel 12 is fastened to the frame side member front planar surfaces 28 by an adhesive and/or by tacks or staples 44, illustrated in FIGS. 2 and 3.

Similarly to the front panel 12, the stiff back panel 14 is disposed on the rear planar surfaces 30 of the flanges 26, with outer edges 46 of the back panel 14 abutting inwardly facing edges 48 of the side members 16. The back panel 14 is fastened to the frame side member rear planar surfaces 30 by adhesive and/or by tacks or staples 50, illustrated in FIGS. 2 and 3.

The two stiff panels 12, 14 define a space therebetween. Each of the panels 12, 14 is provided with holes 52 (FIGS. 1, 8 and 9) which provide ventilation to the back of the canvas 34. The holes 52 also can serve as finger holes for convenient handling of the assembly.

Figure 8:
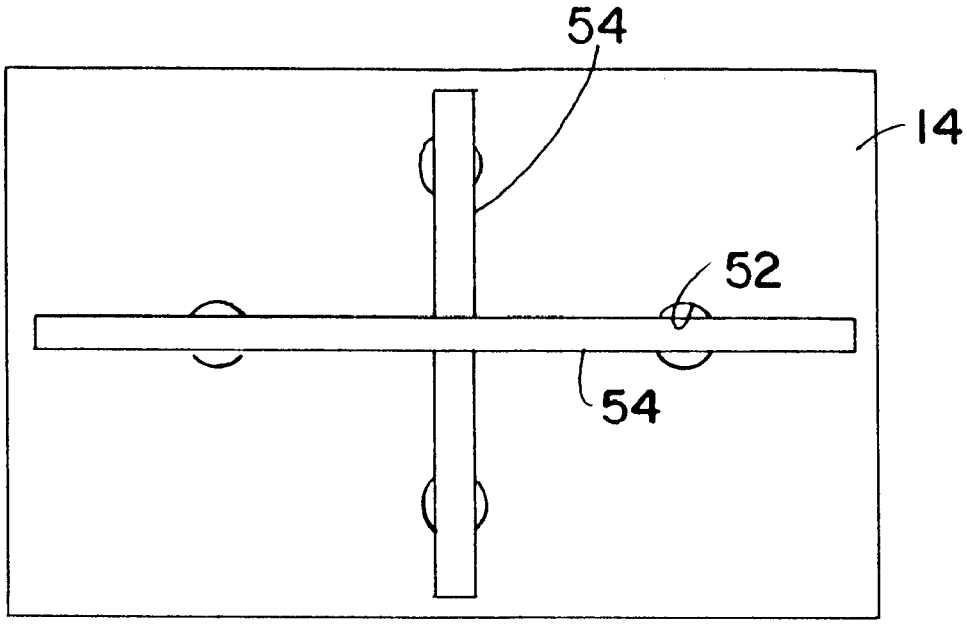
FIG. 8; is a plan view of a panel and spacer portion of the embodiments of FIGS. 1–3.
Figure 9:
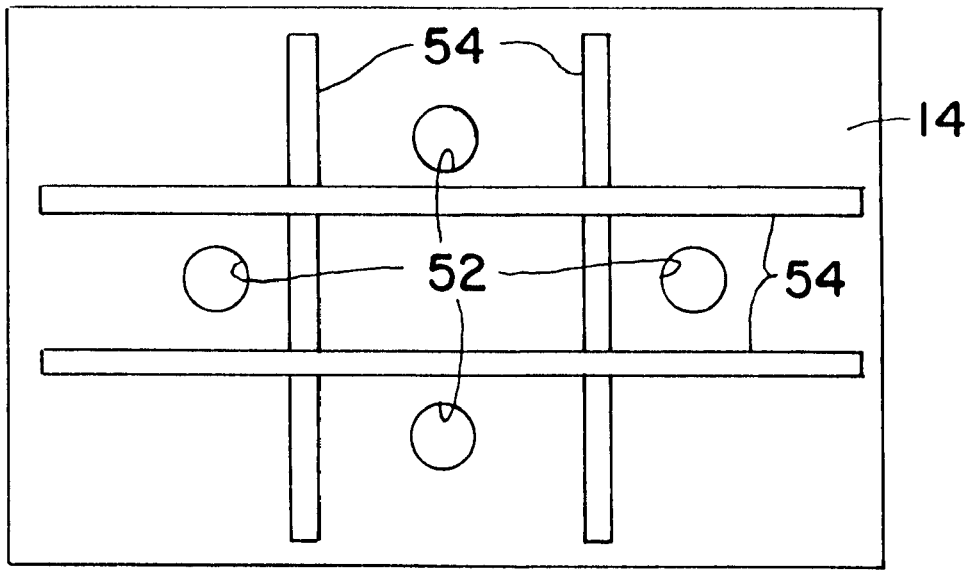
FIG. 9 is similar to FIG. 8, but illustrative of an alternative embodiment of panel and spacer portions.

Spacer blocks 54 are fixed to both of the panels (back panel 14 shown in FIGS. 1, 8 and 9), as by adhesive and/or tacks or staples and are sized to maintain spacing between the panels 12 and 14. In larger frames, a selected larger number of spacer blocks 54 (FIG. 9) may be used. Referring to FIG. 8, it will be seen that the width of the spacer blocks 54 is less than the diameter of the holes 52, such that if the blocks 54 are disposed over the holes 52 the blocks do not entirely cover the holes 52, permitting air to circulate through the holes. Alternatively, the blocks 54 may be disposed in positions removed from the holes 52, as shown in FIG. 9.

The stiff panels 12, 14 are precisely cut in a rectangular configuration. If the frame side members 16 are other than precisely rectangular, they are "squared" to a true rectangle upon attachment of the panels to the frame side members. An inclination of the side members to warp is counteracted by the stiff panels 12, 14. Also, the inclination of the side members to bend or twist under the tension of the canvas is counteracted by the stiff panels 12, 14. The frame members are supported by the panels in all directions.

In assembling the frame assembly, the side members 16 and panels 12, 14 are fixed together, as described above. The canvas 34 is fixed to the flat outer surface 36 of a first of the frame side members 16 by a staple, or the like, at the center of the first frame member. The canvas 34 is then stretched over the opposite frame member 16, typically by use of stretching pliers (not shown) which are used to grasp an edge of the canvas and pull the canvas 34 taught over the frame peripheral rounded edge 24, and over the frame outer flat surface 36. A staple, or the like, is driven through the canvas and into the surface 36 at the center of the opposite frame member to fasten the canvas to the surface 36. Each side is then stapled alternately out to the corners of the respective first and opposite frame side members. The stretching and fastening procedure is repeated for the two remaining frame side members 16.

To avoid having staples or tack heads on the periphery of the assembly, that is, to provide a paintable smooth-edged assembly, the fasteners 32' may be driven into back walls 58 of the side members 16. In an alternative embodiment (FIG. 3), the side members 16 are each provided with a rearwardly-extending flange 60 having a rounded upper edge 62 and the flat back wall 58 for receiving the fasteners 32'. In this embodiment, the frame is wider in cross section with the extended flange 60. Stretching pliers can pivot below the back edge of the frame and the staples are driven into the back wall 58.

Referring to FIG. 4, it will be seen that in an alternative embodiment, the front and back panels 12, 14 are fixed on a core member 70, as by adhesive. Alternatively, the core member 70 and panels 12, 14 may be formed as an integral unit. The side members 16 are provided with a single groove 72 extending from end to end for receiving the core member 70 and panels 12, 14, as a unit. In construction of the embodiment of FIG. 4, the frame side members 16 are adhesively mounted on the pre-cut core and panel unit.

Figure 5:
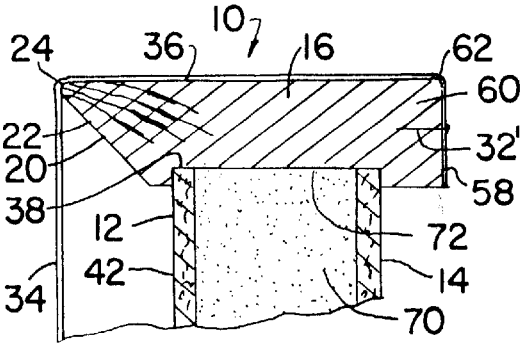

The embodiment illustrated in FIG. 4 may be modified, similarly to the embodiment shown in FIG. 3, so as to provide the rearwardly-extending flange 60 with flat back wall 58 for receiving fasteners 32', so as to free the frame outer flat surfaces 36 of fastening devices. In FIG. 5, there is shown such a structure in combination with the single frame groove 72 and core and panels composite 70, 12, 14.

Figure 6:
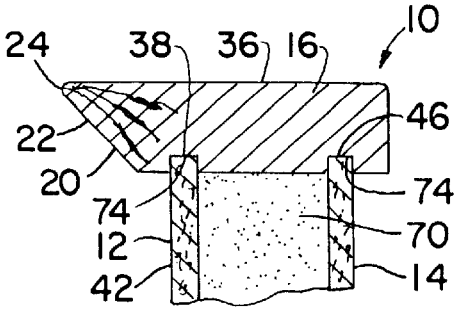

In FIG. 6, there is shown an embodiment similar to that shown in FIG. 4, but instead of the single wide groove 72 a pair of narrow grooves 74 are provided for receiving outer edges 38, 46 of the panels 12, 14, which in this embodiment extend beyond the core member 70.

Figure 7:
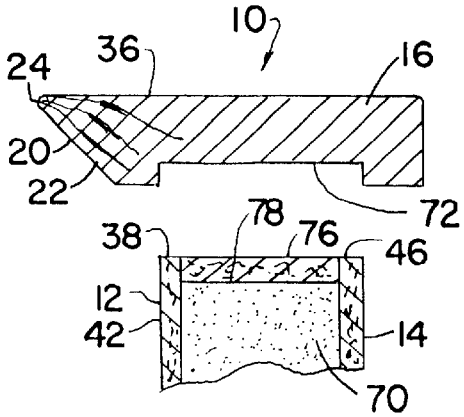
FIG. 7 is an exploded sectional view of another alternative embodiment.

In FIG. 7, there is shown a further alternative embodiment in which there is provided a perimeter strip 76 which is disposed between the panel portions which extend beyond the core member 70. The perimeter strip 76 covers a free edge 78 of the core member 70, and is adapted to be received, along with the extended panel portions, in the frame side member grooves 72.

Figure 10:
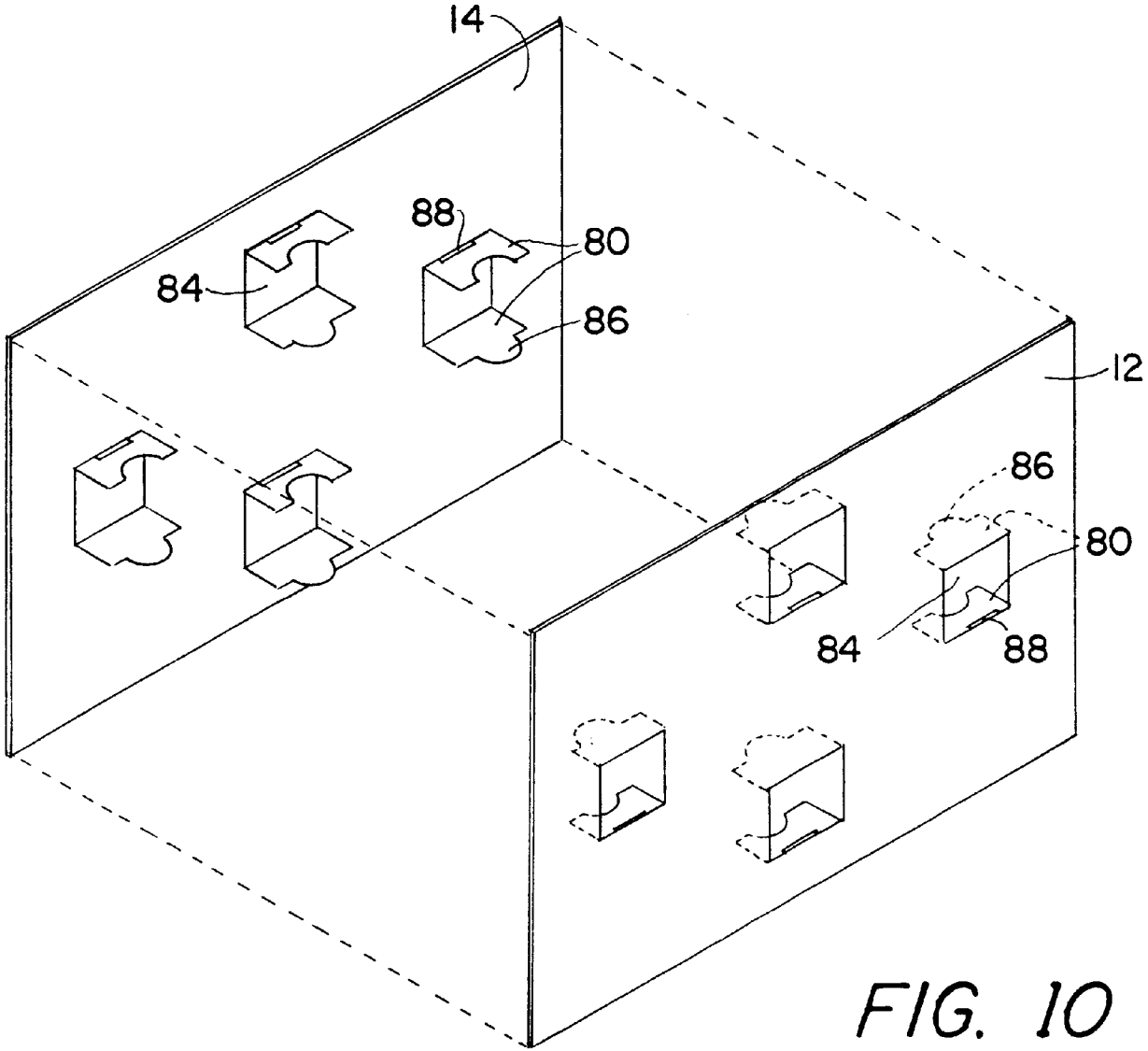
FIG. 10 is an exploded perspective view of another alternative embodiment.
Figure 11A:
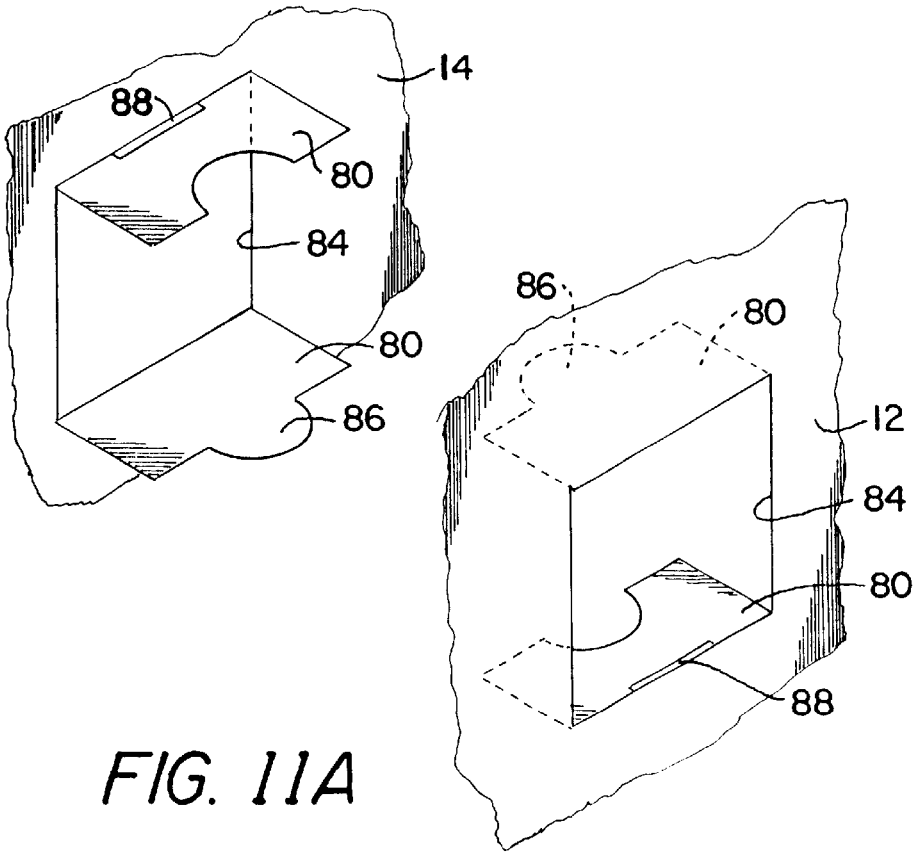
FIG. 11A is a digrammatic perspective view of portions of the embodiment of FIGS. 10 and 11.
Figure 11:
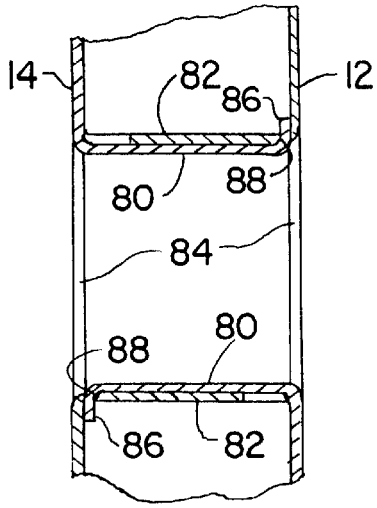
FIG. 11 is a sectional view of a portion of the embodiment of FIG. 10.

In FIGS. 10, 11 and 11A, there is shown a still further alternative embodiment in which the frame side members 16 and panels 12, 14 may be connected according to any of the above-described embodiments, as shown for example in FIG. 1, but in which the spacer blocks 54 and holes 52 are replaced by tabs 80 in each panel 12, 14 (FIG. 10). The tabs 80 are folded toward the other panel and outer ends 86 thereof extended through slots 88 of the other panel to provide spacer struts 82 and holes 84 (FIG.11).

Figure 12:
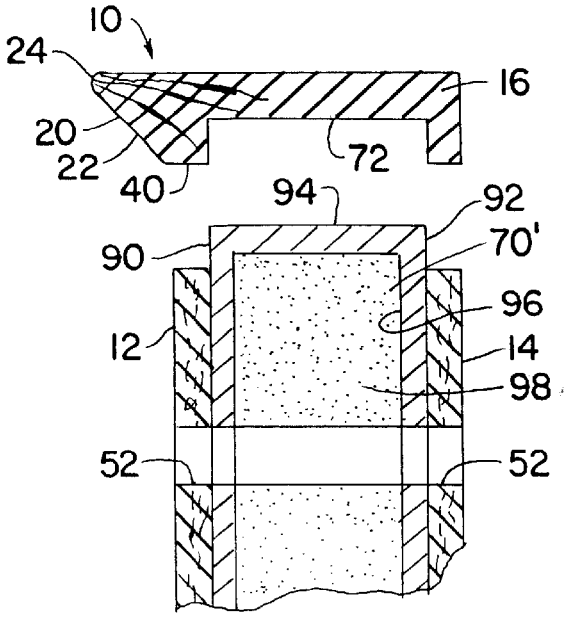
FIG. 12 is an exploded sectional view of a portion of still another alternative embodiment.

Referring to FIG. 12, it will be seen that in still another alternative embodiment the stretcher frame assembly includes the frame having side members 16 fixed to each other at ends thereof. The front face 20 defined by the frame side members 16 declines inwardly from the peripheral rounded edge 24 thereof, and the groove 72 is disposed in inwardly facing edges 40, extending from end to end of each of the side members. A planar core member 70' includes spaced rigid side walls 90, 92 and a peripheral wall 94 interconnecting the side walls 90, 92. The core member walls 90, 92, 94 define a chamber 96, and a filler 98 is disposed in the chamber. The filler 98 typically is of paper, paperboard, styrofoam, or the like. The filler maintains the spacing between the walls 90, 92. The front panel 12 is fixed to the core member 70' on the first side wall 90 of the core member, and the back panel 14 is fixed to the core member 70' on the second side wall 92 of the core member. Edges 94 of the core member 70' are disposed in the grooves 72 of the side members 16. In this embodiment, as well as the embodiments shown in FIGS. 4–7, the aforementioned spacer blocks 54 and/or strips 56, may be omitted.

There is thus provided a stretcher frame assembly having sufficient strength and rigidity to remain "square" and in plane during periods of storage and during use, but of light weight and low cost.

The assembly shown in FIGS. 1–3 and 8–11 provides the further benefit of being readily assembled from kit form. A kit contains four side members 16, front and back panels 12, 14, spacer blocks 54 (or strips 56), and fasteners for fastening together the side member ends 18, and for fastening spacer blocks to both of the panels, and for fastening the front and back panels 12, 14 onto the front and rear planar surfaces 28, 30, respectively. In kits for the embodiment shown in FIGS. 10–11*a*, the spacer members 54 may be omitted. When provided in kit form, it is beneficial from a packing standpoint to provide the panels 12, 14 in a folded condition. For use, the panels 12, 14 are unfolded, as along fold lines 66 shown in FIG. 1 in phantom, to form stiff planar panels. Provided that the fold lines 66 are approximately at a third of the total width, there is no loss of rigidity of the frame.

It is to be understood that the present invention is by no means limited to the particular constructions herein disclosed and/or shown in the drawings, but also comprises any modification or equivalent within the scope of the claims.

What is claimed is:

1. A stretcher frame assembly comprising:

a frame having side members fixed to each other at ends thereof, a front face defined by said frame side members declining inwardly from a peripheral rounded edge thereof, inwardly-extending portions of said frame side members defining inwardly extending flanges having front and rear planar surfaces;

a stiff front panel fixed to said frame with outer peripheral portions of said front panel disposed on and connected to the flange front surfaces; and a stiff back panel fixed to said frame with outer peripheral portions of said back panel disposed on and connected to the flange rear surfaces.

2. The assembly in accordance with claim 1 and further comprising:

a canvas stretched over the front face of said frame and fastened to said frame, said canvas being spaced from said front panel to define an air gap between said front panel and said canvas.

3. The assembly in accordance with claim 1 wherein at least one of said panels is of paperboard.

4. The assembly in accordance with claim 3 wherein said paperboard panel is coated with a waterproofing medium.

5. The assembly in accordance with claim 3 and further comprising a sealant coating on a surface of said front panel facing said canvas.

6. The assembly in accordance with claim 1 wherein said panels are each provided with at least one air hole.

7. The assembly in accordance with claim 1 wherein a spacer member is disposed between said front and back panels.

8. The assembly in accordance with claim 7 wherein said spacer member is fixed to both of said panels.

9. The assembly in accordance with claim 1 wherein a rear face defined by said frame side members is substantially co-planar with a rear surface of said back panel.

10. The assembly in accordance with claim 9 and further comprising:

a canvas stretched over the front face of said frame, the peripheral surface of said frame, and at least a portion of said rear face of said frame, and fixed to at least one of said peripheral surface and said rear surface, said canvas being spaced from said front panel to define an air gap between said front panel and said canvas.

11. The assembly in accordance with claim 1 wherein said frame members are each provided with a peripheral rearwardly extending flange, an outer surface of said rearwardly extending flange being a continuation of said peripheral surface of said frame, said rearwardly extending flange having an undersurface extending rearwardly of said back panel, and a rearward surface extending between the outer surface and the undersurface of said rearwardly extending flange.

12. The assembly in accordance with claim 11 and further comprising:

a canvas stretched over the front face of said frame, the peripheral surface of said frame, the outer surface of said rearwardly extending flange, the rearward surface of said rearwardly extending flange, and the undersurface of said rearwardly extending flange, said canvas being fixed to at least one of said peripheral surface of said frame, the outer surface of said rearwardly extending flange, the rearward surface of said rearwardly extending flange, and the undersurface of said rearwardly extending flange, said canvas being spaced from said front panel to define an air gap between said front panel and said canvas.

13. A stretcher frame assembly comprising:

a frame having side members fixed to each other at ends thereof, a front face defined by said frame side members declining inwardly from a peripheral rounded edge thereof, and a groove in an inwardly-facing surface of each of the side members extending from end to end thereof;

a planar core member;

a front panel fixed to said core member on a first side of said core member; and a back panel fixed to said core member on a second side of said core member;

edges of said core member and said panels being disposed in the grooves of the side members.

14. The assembly in accordance with claim 13 wherein said frame members are each provided with a peripheral rearwardly extending flange, an outer surface of said rearwardly extending flange being a continuation of said peripheral surface of said frame, said rearwardly extending flange having an undersurface extending rearwardly of said back panel, and a rearward surface extending between the outer surface and the undersurface of said rearwardly extending flange.

15. A stretcher frame assembly comprising:

a frame having side members fixed to each other at ends thereof, a front face defined by said frame side members declining inwardly from a peripheral rounded edge thereof, and first and second grooves in an inwardly-facing surface of each of the side members extending from end to end of the side members;

a planar core member;

a stiff front panel fixed to said core member on a first side of said core member and having peripheral portions extending outwardly from peripheral portions of said core member;

a stiff back panel fixed to said core member on a second side of said core member, and having peripheral portions extending outwardly from peripheral portions of said core member;

said peripheral portions of said front and back panels being disposed in the first and second grooves, respectively, of the side members.

16. The assembly in accordance with claim 15 wherein said frame members are each provided with a peripheral rearwardly extending flange, an outer surface of said rearwardly extending flange being a continuation of said peripheral surface of said frame, said rearwardly extending flange having an undersurface extending rearwardly of said back panel, and a rearward surface extending between the outer surface and the undersurface of said rearwardly extending flange.

17. A stretcher frame assembly comprising:

a frame having side members fixed to each other at ends thereof, a front face defined by said frame side members declining inwardly from a peripheral rounded edge thereof, and a groove in an inwardly-facing surface of each of the side members extending from end to end of the side member;

a planar core member;

a front panel fixed to said core member on a first side of said core member;

a back panel fixed to said core member on a second side of said core member;

peripheral edges of said panels extending beyond peripheral edges of said core member to define a peripheral groove; and a perimeter strip fixed to said core member in said peripheral groove;

said perimeter strip and said peripheral edges of said panels being fixed in the frame side member grooves.

18. The assembly in accordance with claim 17 wherein said frame members are each provided with a peripheral rearwardly extending flange, an outer surface of said rearwardly extending flange being a continuation of said peripheral surface of said frame, said rearwardly extending flange having an undersurface extending rearwardly of said back panel, and a rearward surface extending between the outer surface and the undersurface of said rearwardly extending flange.

19. A stretcher frame assembly comprising:

a frame having side members fixed to each other at ends thereof, a front face defined by said frame side members declining inwardly from a peripheral rounded edge thereof;

a stiff front panel having outer peripheral portions thereof fixed to said frame;

a stiff back panel having outer peripheral portions thereof fixed to said frame;

wherein at least one of said panels is provided with a tab bendable toward the other of said panels and insertable at a free end thereof into a slot in the other of said panels to form a spacer strut between said panels.

20. The assembly in accordance with claim 19 wherein the tab is an integral portion of said one panel, and bending of the tab toward the other of the panels opens a hole in said one panel.

21. The assembly in accordance with claim 20 wherein both of said panels are provided with the tabs and the slots.

* * * * *